US008105212B2

(12) United States Patent
Tellez

(10) Patent No.: US 8,105,212 B2
(45) Date of Patent: Jan. 31, 2012

(54) INNER CIRCLE MOUSE PAD

(76) Inventor: Manuel Eduardo Tellez, Miami, FL (US)

( * ) Notice: Subject to any disclaimer, the term of this patent is extended or adjusted under 35 U.S.C. 154(b) by 79 days.

(21) Appl. No.: 12/417,221

(22) Filed: Apr. 2, 2009

(65) Prior Publication Data

US 2009/0253555 A1 Oct. 8, 2009

Related U.S. Application Data

(60) Provisional application No. 61/041,894, filed on Apr. 2, 2008.

(51) Int. Cl.
*A63B 23/16* (2006.01)
*B68G 5/00* (2006.01)

(52) U.S. Cl. ..... 482/44; 482/49; 248/118

(58) Field of Classification Search ..... 482/1, 121, 482/122, 129, 148, 44, 45, 49; 206/315.1; 601/23; 345/161, 163; 248/118, 118.1, 918, 248/346.01

See application file for complete search history.

(56) References Cited

U.S. PATENT DOCUMENTS

| | | | | | |
|---|---|---|---|---|---|
| 1,551,459 | A | | 8/1925 | Blakoe | |
| 4,828,249 | A | | 5/1989 | Keating | |
| 4,852,874 | A | | 8/1989 | Sleichter | |
| 5,158,255 | A | * | 10/1992 | Fuller | 248/118 |
| 5,197,699 | A | * | 3/1993 | Smith et al. | 248/118 |
| 5,342,273 | A | | 8/1994 | Plendl | |
| 5,492,525 | A | | 2/1996 | Gibney | |
| 5,514,055 | A | * | 5/1996 | Elliott | 482/92 |
| 5,562,270 | A | | 10/1996 | Montague | |
| 5,566,913 | A | * | 10/1996 | Prokop | 248/118 |
| 5,692,815 | A | | 12/1997 | Murphy | |
| 5,735,781 | A | | 4/1998 | Pai | |
| 5,830,109 | A | * | 11/1998 | Juarez | 482/44 |
| 5,839,992 | A | * | 11/1998 | Phillips | 482/49 |
| 5,890,999 | A | * | 4/1999 | Kildani | 482/49 |
| 5,945,060 | A | | 8/1999 | Williams | |
| 6,050,964 | A | | 4/2000 | Yates | |
| 6,162,149 | A | * | 12/2000 | Scatterday et al. | 482/49 |
| 6,228,001 | B1 | * | 5/2001 | Johnson et al. | 482/48 |
| 6,315,696 | B1 | * | 11/2001 | Garrioch | 482/49 |

(Continued)

FOREIGN PATENT DOCUMENTS

JP 2003144576 A 5/2003

(Continued)

*Primary Examiner* — Loan Thanh
*Assistant Examiner* — Sandhara Ganesan
(74) *Attorney, Agent, or Firm* — Kenneth Bower

(57) ABSTRACT

An exercise ring with properties ideally suited for exercising by a user sitting at a desk or work station is disclosed. The exercise ring is nested within the outer rim of a computer mouse pad such that a user may easily remove the device and use it while seated at a desk or work station and serves the second function as a wrist rest when mounted on the mouse pad. The exercise ring is made of elastic material that exhibits high visco-elastic properties when being manually stretched and contracted. The unique visco-elastic properties cause the exercise ring to exert a larger force on the user's muscles when the ring is being stretched and a smaller force is exerted on the user's muscles while the ring is being contracted. This combination of exercise ring properties has been found to provide an optimum work out when exercising in a confined space and reduces the chance of the user being impacted by an accidentally released exercise ring. Frequent exercise is encouraged by additional embodiments that introduce new exercise regimens to the user and track the users exercise habits.

20 Claims, 4 Drawing Sheets

U.S. PATENT DOCUMENTS

Figure 1:
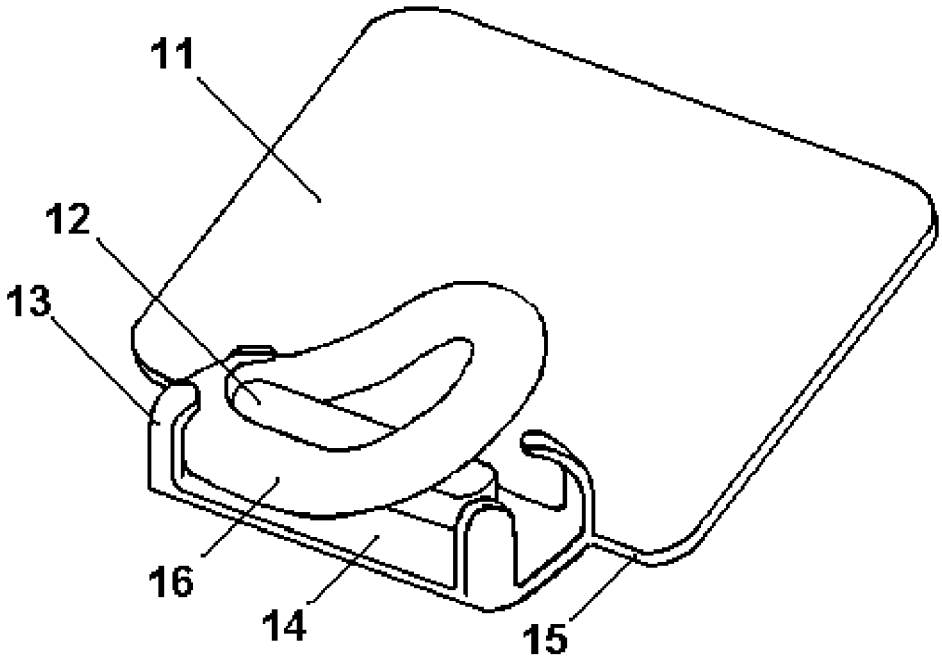

| | | | | |
|---|---|---|---|---|
| 6,322,479 | B1 * | 11/2001 | Pharaoh | 482/44 |
| 6,323,841 | B1 * | 11/2001 | Lai | 345/163 |
| 6,328,675 | B1 * | 12/2001 | Kaye | 482/44 |
| 6,402,101 | B1 | 6/2002 | Yates | |
| D462,098 | S | 8/2002 | Fazeli | |
| 6,755,350 | B2 * | 6/2004 | Rochford et al. | 239/34 |
| 6,932,747 | B2 | 8/2005 | Herman | |
| 6,962,311 | B1 * | 11/2005 | Sykes | 248/118 |
| 7,037,240 | B2 | 5/2006 | Pemberton | |
| 7,300,026 | B2 * | 11/2007 | Pap | 248/118 |
| 7,837,599 | B2 * | 11/2010 | Kowalczewski et al. | 482/44 |
| 2002/0072451 | A1 * | 6/2002 | Scatterday | 482/49 |
| 2002/0125379 | A1 | 9/2002 | Money et al. | |
| 2002/0148939 | A1 | 10/2002 | Adams | |
| 2003/0069109 | A1 | 4/2003 | Bender | |
| 2003/0139257 | A1 * | 7/2003 | Pemberton | 482/44 |
| 2003/0151554 | A1 | 8/2003 | McCarthy | |
| 2003/0191204 | A1 * | 10/2003 | Hermann et al. | 521/82 |
| 2004/0067827 | A1 | 4/2004 | Tustin | |
| 2004/0072653 | A1 * | 4/2004 | Minuto et al. | 482/49 |
| 2006/0036305 | A1 * | 2/2006 | Koby et al. | 607/109 |
| 2006/0229174 | A1 * | 10/2006 | Bonutti | 482/111 |
| 2007/0219073 | A1 | 9/2007 | Mannschedel | |
| 2007/0249469 | A1 * | 10/2007 | Chernick et al. | 482/44 |
| 2008/0032876 | A1 | 2/2008 | Mukenev | |
| 2008/0146336 | A1 | 6/2008 | Feldman | |
| 2009/0029830 | A1 * | 1/2009 | Chiang | 482/44 |

FOREIGN PATENT DOCUMENTS

| | | | |
|---|---|---|---|
| JP | 2004073517 | A | 3/2004 |
| JP | 2008023302 | A | 2/2008 |

* cited by examiner

INNER CIRCLE MOUSE PAD

CROSS-REFERENCE TO RELATED APPLICATIONS

This application claims U.S. Provisional Application No. 61/041,894 filed on Apr. 2, 2008.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The field of invention is in exercise devices. More specifically, the present invention relates to an exercise device applying a force due to elastic resistance to motion which in a preferred embodiment is combined with desktop computer, digital devices or digital device accessories. The preferred embodiment is a ring-shaped exercise device, having pathway-dependent hysteretic properties, combined with a computer mouse pad.

2. Description of Related Art

It is known that lack of exercise is a major cause of health problems. Lack of access to suitable exercise equipment in the few free moments people have during business days is often cited as the reason for this deficiency.

It is also known that consumers purchase exercise equipment with an eye toward portability, storability and ease of use. Ease of exercising at a computer work station is a desirable feature since the modern professional spends a large portion of their professional and personal life at the computer. It is believed that an exercise device that has portability, storability and ease of use will have a higher probability of being used and therefore achieve the desired outcome of improved physical fitness and health.

In addition, it also known that the working of larger muscle groups, such as the upper arms and core muscles often requires larger pieces of exercise equipment to account for the increased range of motion.

What is needed is an exercise device that integrates into the users work area in a new way, while providing resistance training for both large and small muscle groups.

The patent to Tyner (U.S. Pat. No. 6,644,605) discloses a computer keyboard tray that provides a mouse pad, a copy stand for the support of printed material and a wrist support for use in a computer environment, however it lacks a means of exercising in the environment in a computer or other digital devices or device accessories.

The patent to Yates (U.S. Pat. No. 6,050,964) discloses a computer mouse pad with a dedicated wrist support. However, it lacks a means of exercising and also lacks a stand for the support of printed material.

The patent to Orchard et al. (U.S. Pat. No. 4,621,808) discloses a ring shaped exercise weight made with a covering of visco-elastic material. Orchard et al. lacks a mouse pad, stand for printed material, wrist support and connection to the computer or other digital device or accessory environment.

BRIEF SUMMARY OF THE INVENTION

The preferred embodiment of the invention is an exercise ring nested within and serving as the outer edge of a wrist pad that is used in combination with a mouse pad.

The first component of the present invention is an exercise ring. The exercise ring is made of silicone, or another elastic material that also exhibits viscous properties. The ring can be used for various exercises by holding one side fixed and pulling on the other side. To vary resistance, the ring thickness can be changed or the material can be altered.

The material for the exercise ring is chosen with several factors in mind. In the preferred embodiment, a silicone with high hysteresis is used. Other embodiments may include urethane elastomers or thermoplastic elastomers such as the T-Gels provided by Gel Smart™, LLC of Whippany, N.J., manufactures a material with an adequate elastic property, the material has both an hysteresis and a viscous property. As the ring is stretched, some of the energy is stored by the elastic property and some of the energy is converted to heat by the viscous property. The end result is an exercise device with high resistance to motion when stretching, and an apparent drop in resistance to motion when releasing.

The hysteresis property provided by the silicone or the urethane elastomer is important to the present invention because of the path dependent feel to the exercise ring. This path dependent feel consists of high resistance when stretching and apparent lower resistance when contracting. By providing lower resistance when contracting, the exercise ring will not slap the user if the ring were to accidentally released. Moreover, the slow contraction of the exercise ring provides an unexpectedly comfortable feel when exercising with the device. Finally, the selected material exhibits excellent memory and recovery. This means that the user may continuously stretch the exercise ring and have confidence that the exercise ring will return to the original shape. In addition to the hysteresis property, it is also contemplated that the present invention may emit a scent during use by incorporation of various aroma emitters imbedded in the viscoelastic material.

The second primary component for the present invention is a mouse pad in combination with an exercise ring holder. The exercise ring holder is detachable from the mouse pad, and it serves as both wrist support and holder for the previously mentioned exercise ring.

By mounting the exercise ring in the elastic ring holder, the exercise ring is readily available to a person working at a desk playing computer games or any other activity associated with a computer and a mouse pad. In addition, the exercise ring activates a switch on the exercise ring holder. When the exercise ring is removed, the switch closes, which causes a light to come on in the mouse pad. The now illuminated mouse pad reveals instructions for various exercises which can be performed by the user. In addition, when the mouse pad is detached from the exercise ring holder, the exercise ring holder can mount the mouse pad in a vertical orientation on the desk. This enables the user to stand the mouse pad on his or her desk, and view the recommended set of exercises.

BRIEF DESCRIPTION OF THE SEVERAL VIEWS OF THE DRAWING(S)

FIG. 1—Perspective view of an exercise ring being removed from a mouse pad of the preferred embodiment of the present invention.

Figure 2:
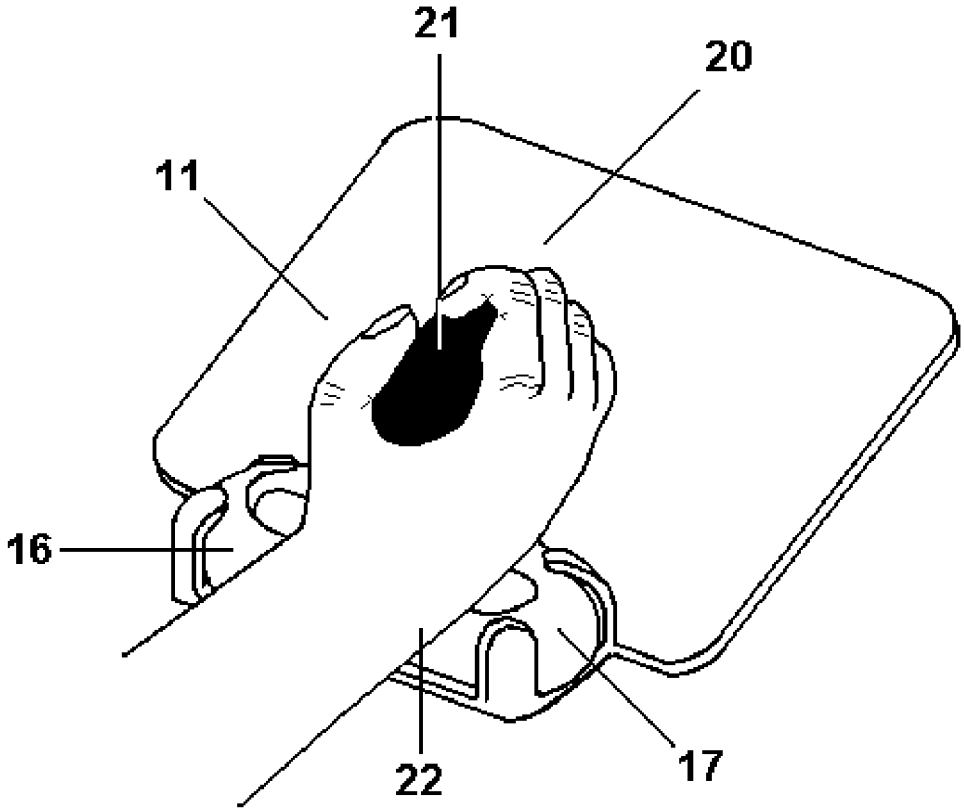

FIG. 2—Perspective view of an exercise ring acting as a wrist rest on a mouse pad of the preferred embodiment of the present invention.

Figure 3:
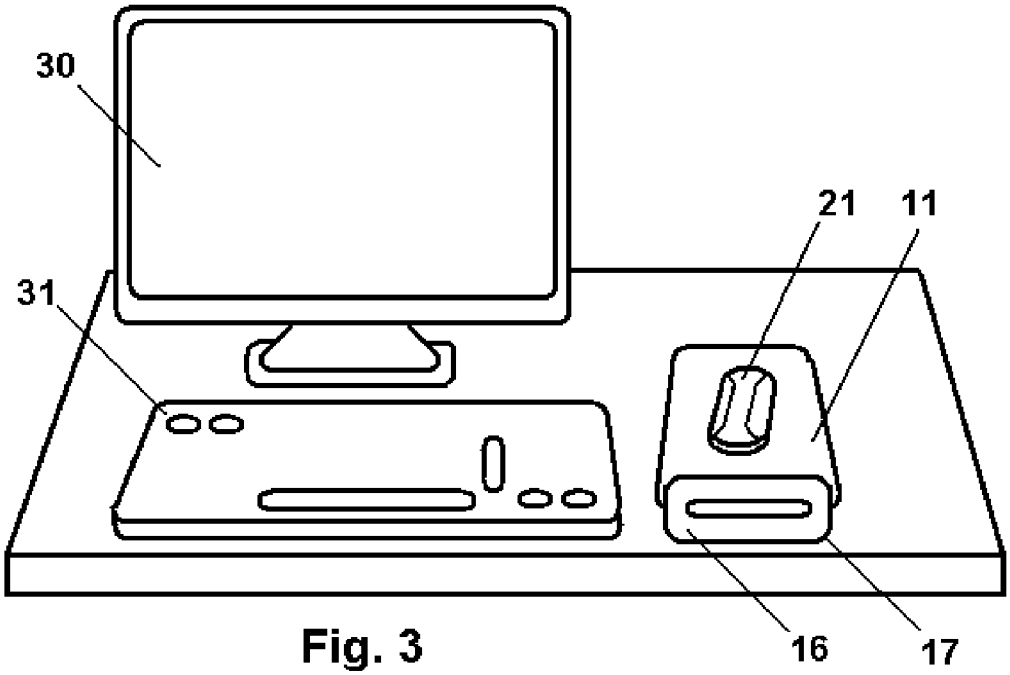

FIG. 3—Perspective view of a computer work station configured for computer activity.

Figure 4:
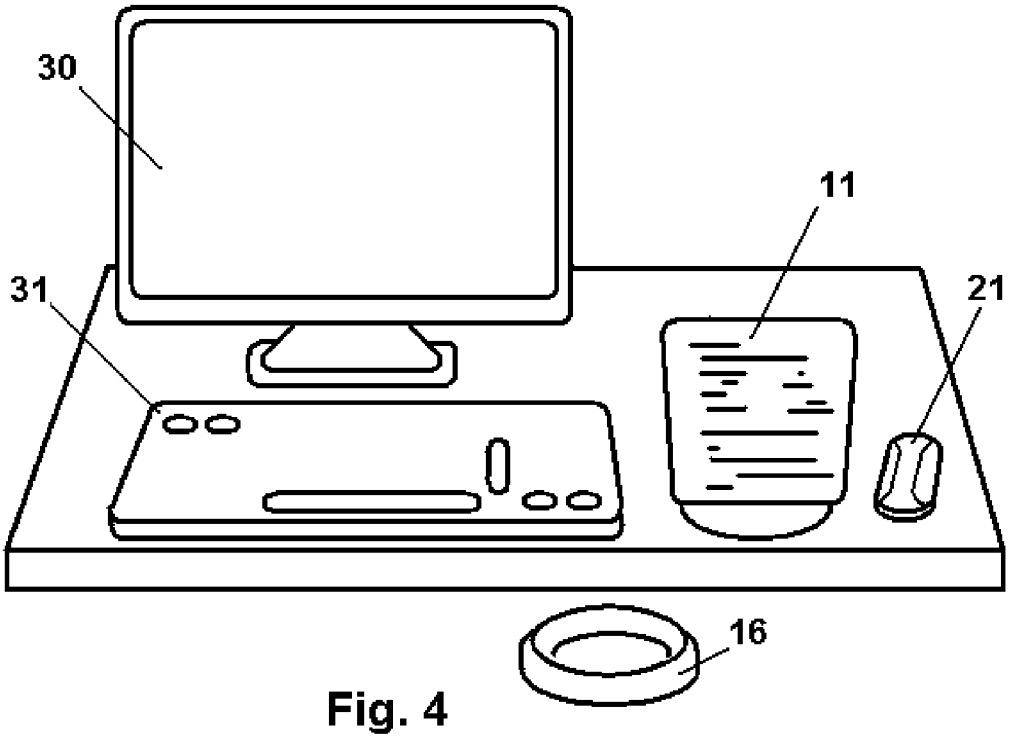

FIG. 4—Perspective view of a computer work station configured for exercise activity.

Figure 5:
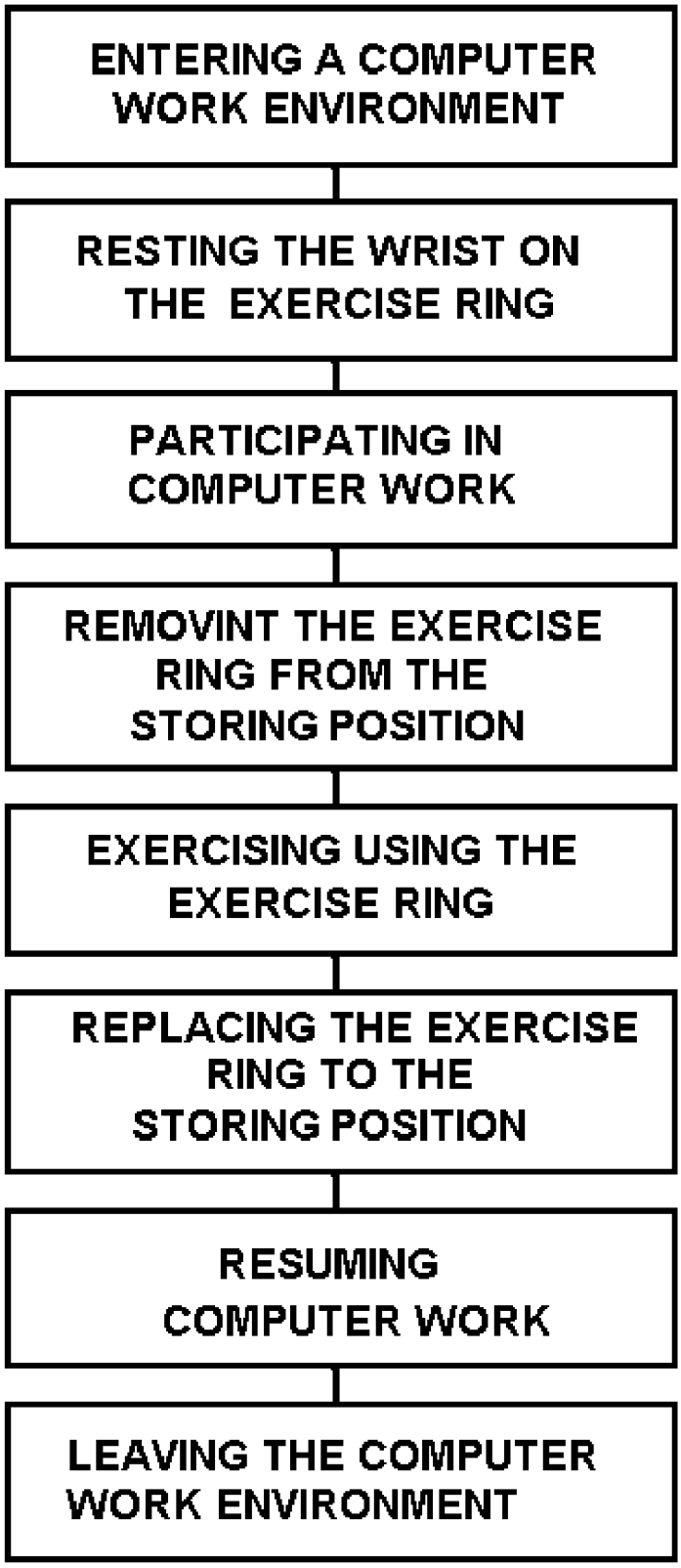

FIG. 5—Block diagram of a method of use of the preferred embodiment of the present invention.

Figure 6:
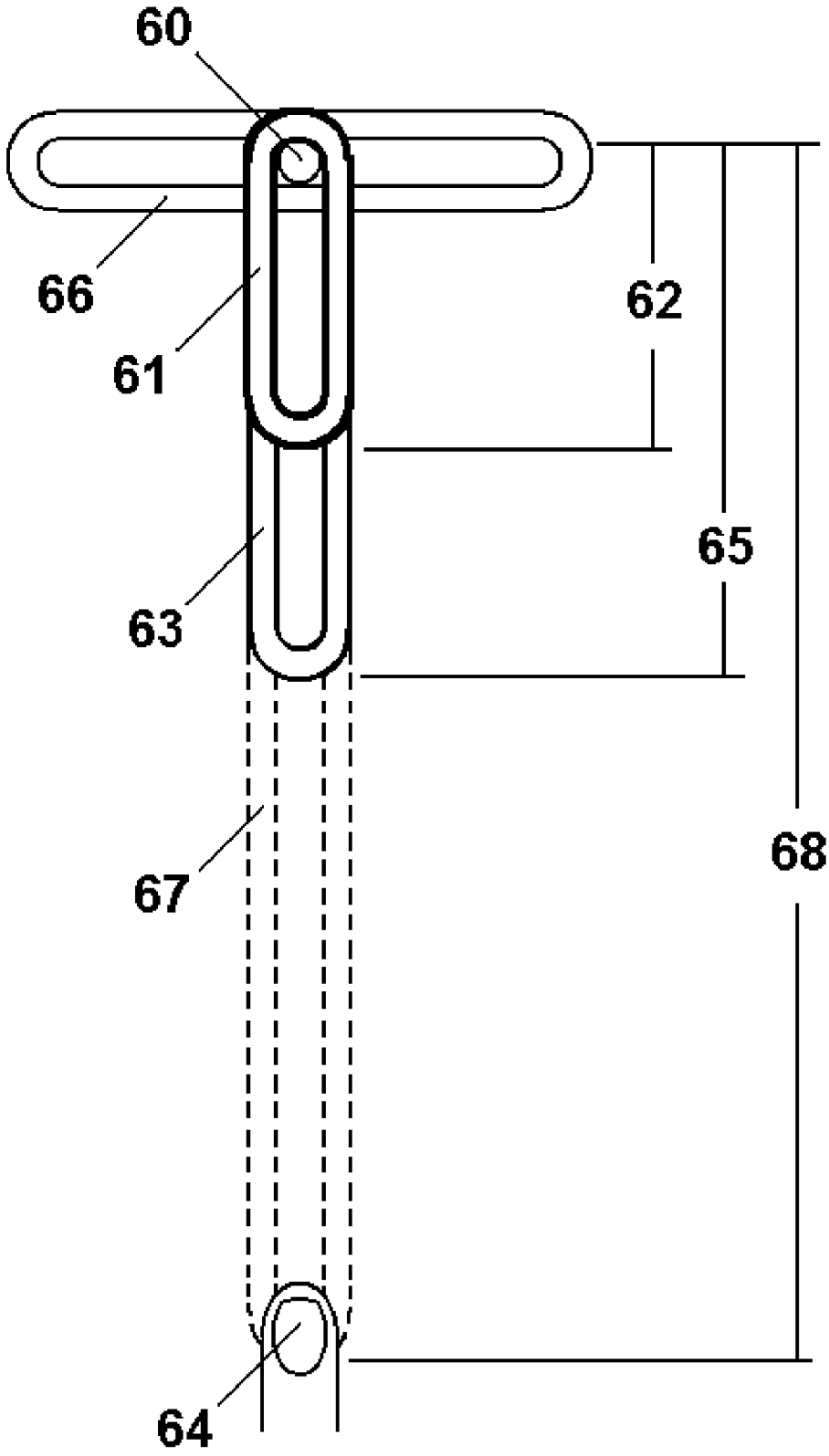

FIG. 6—Top view of a simple measurement method for comparing visco-elastic properties of exercise bands.

DETAILED DESCRIPTION OF THE INVENTION

Referring now to FIG. 1, where a computer mouse pad 11 is shown having an oval shaped hub 12 and four fingers 13 that make up an exercise ring holder 14 attached to the bottom edge 15 of the mouse pad 11. The exercise ring 16, of the preferred embodiment of the present invention is shown in a position where it is half way inserted into the exercise ring holder 14. An exercise ring 16 totally engaged in the ring holder 14 is referred to as being in the storing position 17 as illustrated in FIG. 2. The key to the design of the exercise ring holder 14 is having the top surface of the exercise ring 16 protrude upwards beyond the hub 13 and fingers 14 of the exercise ring holder 14 for unobstructed support of anything set on the assembly from above.

Referring now to FIG. 2, the mouse pad 11 is shown with the exercise ring 16 in the storing position 17. The user's hand 20 is grasping a computer mouse 21 for providing input instructions to a computer (un-shown). The user's wrist 22 is supported by the upper surface of the exercise ring 16 that is shown in the storing position 17.

Referring now to FIG. 3, shown is a typical desk top computer workstation with a monitor 30, keyboard 31, mouse 21, computer mouse pad 11 with the exercise ring 16 in the storing position 17. The elastic band 16 can be of any cross section or multiple or changing cross sections, the surface can be bare, covered or textured and any elastic material may be used in its manufacture.

In the preferred embodiment, however, the exercise ring is of a torus geometry, having a bare and smooth surface and the material has exceptional hysteresis and visco-elastic properties. These exceptional properties can be easily measured by extending the exercise ring to several times its relaxed length while holding it three feet off of the ground, releasing one end and observing how far the released end travels before the ring reaches the ground. If the released end does not travel to the point where the un-released support is positioned the material has exceptional hysteresis and visco-elastic properties.

Referring now to FIG. 4, shown is the typical desk top computer workstation as shown in FIG. 3 with a monitor 30, keyboard 31, mouse 21, computer mouse pad 11. The computer mouse pad 11 has been repositioned to make it easier to read the exercise program printed on the mouse pad 11 surface. The exercise ring 16 has been released from the storing position 17 as shown in FIG. 3 and is now in what we refer to as the exercise position which is anywhere the user positions the ring for the performance of exercises.

Referring to FIG. 5 where a block diagram illustrates one method of use of the preferred embodiment of the instant invention. Method step 50 refers to entering an office, data entry or other environment that is atypical for exercise activity. The term computer work environment should be taken in the broadest interpretation to include a learning or playing environment as well as any environment where a computer or other digital device can be found. Method step 51 refers to using the exercise ring 16 as a wrist rest while operating the computer or other digital device. Method step 52 refers to participating in activity that is appropriate to the setting where a computer or other digital device can be found. Method step 53 refers to the operator of the computer or a second party removing the exercise ring 16 from the exercise ring holder 14. Method step 54 has the operator performing some form of exercise using the exercise ring 16. In method step 55 the user replaces the exercise device to the storing position 17 on the mouse pad or digital device accessory. Method step 56 refers to the user returning to the computer activity of method step 52. In method step 57 the user leaves the computer work environment they entered in step 50. It is believed that this series of method steps as stated with additional or omitted steps will lead to a happier, healthier community of computer users.

Referring lastly to FIG. 6, a simple test providing a rough measurement of visco-elastic properties of exercise bands. The only test apparatus is a round rod 60 that is held in a vertical position in the testers first hand (un-shown). An elastic exercise band 61 is looped around the round rod 60 (a pencil or pen works) at one end and held between the index finger (un-shown) and thumb (un-shown) of the person performing the simple test at the opposite end.

The first step in the simple test exercise band 61 is to measure the first band length with the band held taught but not stretched to a relaxed length 62.

The second step of the simple test is to stretch the exercise band to the second position 63 between the index finger (un-shown) and thumb (un-shown) of the person performing the simple test which extends the exercise band to length 65 which is twice the length of the exercise band in the relaxed position 62.

The third step of the simple test is to release the band 63 allowing the exercise band to lunge towards the round rod 60. Materials that achieve the desired feel to the user exercising with the exercise band will not impact the rod 60 after release.

The fourth step of the simple test is to stretch the exercise band to the third position 67 between the index finger (un-shown) and thumb 64 of the person performing the simple test which extends the exercise band to length 68 which is five times the length of the exercise band in the first position 62.

The fifth step of the simple test is to release the band 61 allowing it to lunge towards the round rod 60. Materials that achieve the desired feel to the user exercising with the exercise band will impact the round rod 60 after release.

The five steps of the simple test were performed using two exercise bands to evaluate whether the simple test distinguishes between state of the art elastic bands of exercise BAND A and a visco-elastic exercise band of the instant invention, BAND B.

SIMPLE TEST DISTINGUISHING AFFECT OF VISCO-ELASTIC PROPERTIES

| | BAND A: | BAND B: |
|---|---|---|
| Band Material Dia.: | 2" | 2" |
| First Step Length: | 10" | 10" |
| Second Step Length: | 20" | 20" |
| Third Step Result: | Band Struck Rod | Band Did Not Strike Rod |
| Fourth Step Length: | 50" | 50" |
| Fifth Step Result: | Band Struck Rod Forcefully | Band Barely Reached Rod |

I claim:

1. An exercise system for use in an office, computer operation, programming, communication or data-entry environment that is otherwise atypical of supporting exercise, comprising:

a computer accessory adapted to change between a first mode and a second mode;

a torus-shaped exercise device; and a hub extending from the computer accessory, wherein the central aperture of the torus-shaped exercise device is adapted to fit around the hub in the first mode, and wherein the exercise device protrudes upwards beyond the hub in the first mode;

wherein the first mode provides support of a user's body part while the user is operating a digital device;

wherein the exercise device is removed from the computer accessory in the second mode for use during exercise.

2. The exercise system of claim 1, wherein:

an exercise is performed by the user holding a first side of the exercise device fixed and pulling on a second side of the exercise device.

3. The exercise system of claim 2, further comprising:

a surface on the computer accessory for placement of the digital device.

4. The exercise system of claim 2, wherein:

the body part is one of: i. a palm, ii. a wrist, iii. a lower arm.

5. The exercise system of claim 2, wherein:

the computer accessory displays instructions for use of the exercise device.

6. The exercise system of claim 1, wherein:

the exercise device produces a high resistance when stretching and a lower resistance when contracting.

7. The exercise system of claim 6, further comprising:

a surface on the computer accessory for placement of the digital device.

8. The exercise system of claim 6, wherein:

the body part is one of: i. a palm, ii. a wrist, iii. a lower arm.

9. The exercise system of claim 6, wherein:

the computer accessory displays instructions for use of the exercise device.

10. The exercise system of claim 1, wherein:

the properties of the exercise device retard the contraction of the exercise device for avoiding injury if the device is released from an extended position.

11. The exercise system of claim 10, further comprising:

a surface on the computer accessory for placement of the digital device.

12. The exercise system of claim 10, wherein:

the body part is one of: i. a palm, ii. a wrist, iii. a lower arm.

13. The exercise system of claim 10, wherein:

The computer accessory displays instructions for use of the exercise device.

14. The exercise system of claim 1, wherein:

the exercise device gives off a scent during use giving olfactory feed back to the user during exercise.

15. The exercise system of claim 14, further comprising:

a surface on the computer accessory for placement of the digital device.

16. The exercise system of claim 14, wherein:

the body part is one of: i. a palm, ii. a wrist, iii. a lower arm.

17. The exercise system of claim 1, further comprising:

a surface on the computer accessory for placement of the digital device.

18. The exercise system of claim 1, wherein:

the body part is one of: i. a palm, ii. a wrist, iii. a lower arm.

19. The exercise system of claim 1, wherein:

the computer accessory displays instructions for use of the exercise device.

20. The exercise system of claim 1, further comprising a plurality of fingers extending from the computer accessory, the plurality of fingers adapted to contact a portion of an exterior circumference of the exercise device in the first mode.

* * * * *